US005088944A

United States Patent [19]

Kats

[11] Patent Number: 5,088,944

[45] Date of Patent: Feb. 18, 1992

[54] COLLAPSIBLE WATER BIKE

[76] Inventor: Simon Kats, 46 Hapalmach St., G'Vataim, Israel, 53406

[21] Appl. No.: 608,982

[22] Filed: Nov. 5, 1990

[51] Int. Cl.[5] ..... B63H 16/20

[52] U.S. Cl. ..... 440/26; 440/31

[58] Field of Search ..... 440/21, 12, 26, 31; 403/379; 280/287; 114/354

[56] References Cited

U.S. PATENT DOCUMENTS 637,547 11/1899 Clark ..... 440/31

909,247 1/1909 Spry ..... 403/379

2,746,769 5/1956 Hoogendoorn ..... 403/379

3,352,276 11/1967 Zimmerman ..... 440/31 X

*Primary Examiner*—Sherman Basinger

*Attorney, Agent, or Firm*—Terry M. Gernstein

[57] ABSTRACT

A collapsible water bike includes a plurality of assemblies which are interconnectable using connecting assemblies that are easily locked and unlocked. The bike is driven by a pedal assembly that is operatively connected to a propeller and is steered by handlebars that are connected to a rudder.

1 Claim, 1 Drawing Sheet

COLLAPSIBLE WATER BIKE

TECHNICAL FIELD OF THE INVENTION

The present invention relates to the general art of water vehicles, and to the particular field of manually propelled water vehicles.

BACKGROUND OF THE INVENTION

More and more people are enjoying a great variety of water sports. These sports range from fishing and boating to water skiing and sailing. One thing most of these endeavors have in common is the need for some sort of propulsion, with the most common form of propulsion being a combustion engine or wind power.

While this mode of propulsion is quite effective, there are times when it is not acceptable or simply not desired. For example, if the boat is to be used for fishing, the noise of a motor may not be desired, yet a sail boat is not suitable. Still further, there are times when a person simply wants a type of exercise that is not attainable using a sailboat or a motor boat.

Accordingly, the art has included designs for boats that are manually powered by pedals or the like. These designs range from strictly pedal boats to combinations of bicycles and boats.

However, many of these pedal boats are too cumbersore to transport to a particular location, and thus are of little use unless a person has a truck or like vehicle. If a person simply has a car and wants to place the pedal boat in the trunk of that car, it is not possible with the pedal boats presently available.

Accordingly, there is a need for a collapsible water bike-type vehicle that is driven by manually rotating pedals and yet can be collapsed into a small package and can be easily knocked down and set up without the need of special tools.

OBJECTS OF THE INVENTION

It is a main object of the present invention to provide a collapsible water bike-type vehicle that is driven by manually rotating pedals.

It is another object of the present invention to provide a collapsible water bike-type vehicle that is driven by manually rotating pedals and yet can be collapsed into a small package.

It is another object of the present invention to provide a collapsible water bike type vehicle that is driven by manually rotating pedals and yet can be collapsed into a small package and can be easily knocked down and set up without the need of special tools.

SUMMARY OF THE INVENTION

These, and other, objects are achieved by a collapsible water bike that has a plurality of assemblies that are connected together by connecting assemblies which can be operated without the need of special tools.

In this manner, the bike can be easily disassembled for storage and transport, and then easily re-assembled without requiring great manual dexterity and special tools. The bike can thus be transported in the trunk of an automobile and assembled on site.

BRIEF DESCRIPTION OF THE DRAWING FIGURES

DETAILED DESCRIPTION OF THE PREFERRED EMBODIMENT OF THE INVENTION

Figure 1:
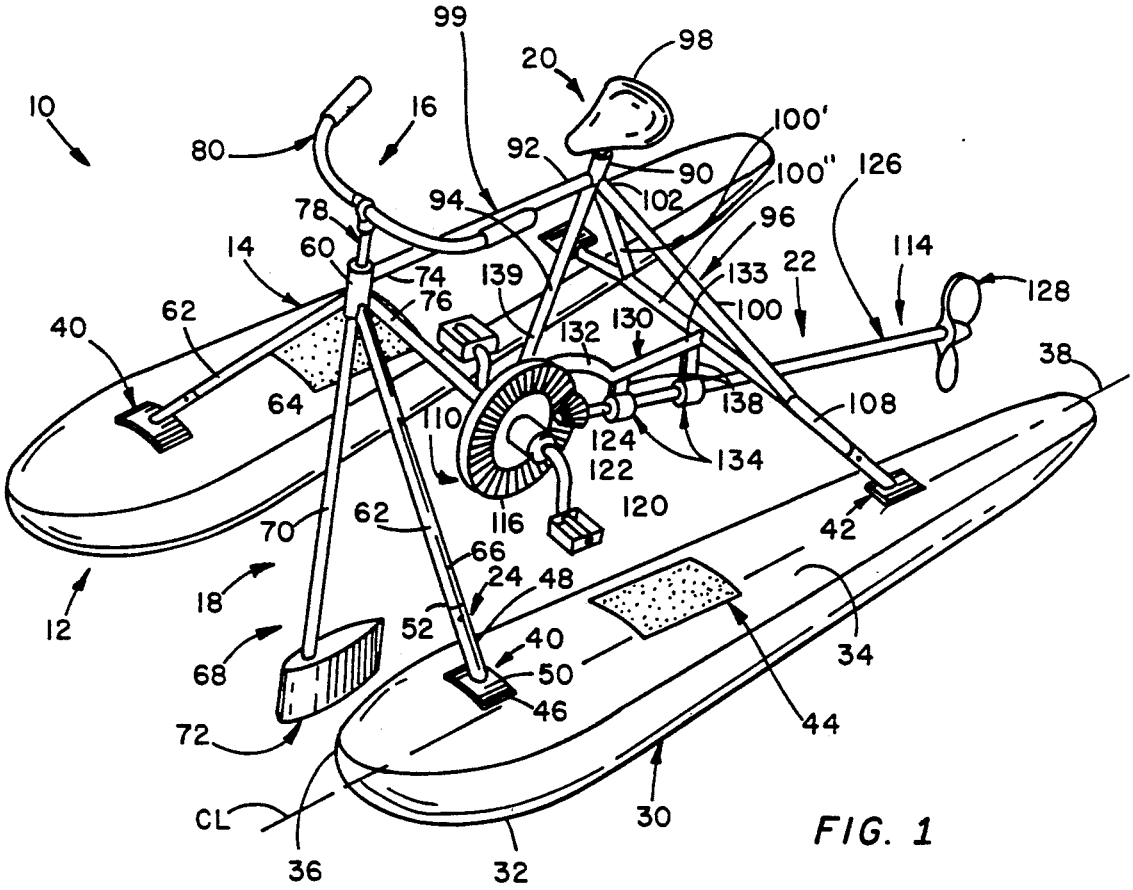
FIG. 1 is a perspective view of a collapsible water bike embodying the present invention.

Shown in FIG. 1 is a collapsible water bike 10 of the present invention. The bike can be collapsed and carried in a convenient manner because it consists of a minimum number of simple parts, and can then be easily set up for use in a matter of minutes without the need of special tools.

The collapsible water bike consists entirely of several main assemblies that include a pontoon assembly 12, a front frame assembly 14, a handle bar assembly 16, a steering assembly 18, a seat assembly 20 and a propulsion assembly 22 which are all releasably connected together by connecting assemblies, such as connecting assembly 24.

The pontoon assembly includes two identical pontoons 30, each having a bottom surface 32 that is shaped for hydrodynamic efficiency and which rides in a body of water in which the bike is being used. Each pontoon further includes a top surface 34 and a fore end 36 and an aft end 38, with the pontoon being tapered along its longitudinal centerline CL from the fore end to the aft end. A forward mounting bracket assembly 40 is located near the fore end and a rear mounting bracket assembly 42 is located near the aft end of the pontoon, with a non-skid pad 44 mounted on the pontoon top surface between the mounting brackets.

Each mounting bracket assembly 40 and 42 includes a mounting base 46 affixed to the pontoon at the longitudinal centerline CL, with a tubular body 48 affixed at one end 50 thereof to the mounting base 46 and having a female end 42 spaced above the pontoon top surface 34. The fore bracket assembly 40 has the tubular body extending transversely of the longitudinal centerline CL towards a side of the pontoon, while the aft mounting bracket assembly 42 has tubular body 48' extending forwardly along the longitudinal centerline but at an acute angle with respect thereto.

The front frame assembly 14 includes a cylindrical head tube 60 having two identical support tubes 62 attached at an upper end 64 thereof to that support tube and diverging downwardly away from each other from the support tube to a male end 66 which is releasably coupled to a fore mounting bracket assembly 40 on each pontoon by a connecting assembly.

The steering assembly 18 includes a rudder element 68 having a support rod 70 attached at one end to the head tube and having a rudder element 72 on a second end thereof. The rudder element is located to be immersed in the water for steering purposes.

The front frame assembly further includes a crossbar receiving tube 74 mounted at one end thereof on the head tube and having a female end on the other end, and a downtube mounting bracket assembly 76 also mounted on the head tube.

The handlebar assembly 16 includes a handlebar bracket element 78 connected to the head tube and operatively connected to the rudder element rod 70 to rotate that rod in response to movement of handlebars 80 to steer the vehicle.

The seat assembly 20 includes a seat post 90 to which is attached a crossbar mounting bracket assembly 92 which has a female end on an opposite end thereof, and a seat tube 94 which depends therefrom to a male end, as well as a triangular supporting frame unit 96. A seat 98 is mounted on the seat tube 90 to extend upwardly therefrom, and a crossbar 99 having two male ends is connected at one end to the seat post via a connecting assembly and at the other end to the crossbar receiving tube element 74 via another connecting assembly.

The seat supporting frame 96 is unitary and includes three identical frame tubes 100, 100' and 100'' which are connected together to form an equilateral triangle with one apex 102 thereof connected to the seat post 90 so that the triangular configuration is in a plane that extends downwardly and rearwardly from the seat post. Each of the other two apexes 104 and 106 has a connection tube 108 extending outwardly of the triangle to a male end, and which is connected to the rear mounting brackets 42 by connecting assemblies.

The propulsion assembly 22 includes a driver unit 110 having a driver gear 112 mounted on the seat tube 94 by a connecting assembly and a propeller unit 114 operatively connected to the driver unit 110 to be driven thereby. The driver unit 110 includes a driver gear 116 having teeth on the peripheral edge thereof and which is driven by foot pedals 120 connected thereto by L-shaped crank arms 122. Meshed with the gear teeth on the driver gear 116 is a driven gear element 124 that is mounted on one end of a drive shaft rod 126 that has a propeller 128 on the other end thereof.

A support element 130 includes a bracket arm 132 attached at one end to the seat tube 94 and at a male end to the triangle leg 100'' by a connecting assembly in conjunction with a mounting bracket assembly 133 on the leg 100''. The bracket arm 132 includes two support bearings 134 connected thereto by bearing arms 138 and 138'. It is noted that the bearing arm 138' is mounted on the bracket assembly 133. This facilitates assembly and knockdown of the bike. The drive shaft extends through the bearings and is supported in driving position thereby. A mounting bracket 139 is connected at one end to the support element bracket arm 132 and at a female end to a male end of the seat tube 94 by a connecting assembly.

Peddling the bike pedals will rotate the propeller via the drive shaft and the operative connection of the driver gear and the driven gear element, and rotating the handlebars will steer the bike via the connection between the handlebars and the rudder.

Figure 2:
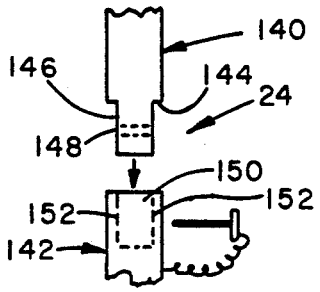
FIG. 2 is an elevational view of a portion of a connecting assembly used to connect the various parts of the bike together.

All of the aforementioned connecting assemblies are similar, and one such connection assembly is shown in FIG. 2. The connection assembly includes a male element 140 and a female element 142 which are connected together. The male element includes an annular shoulder 144 surrounding a projection 146 that extends along the longitudinal centerline of the male element, and which has a bore 148 extending transversely to that longitudinal centerline. The female element includes a bore 150 defined to extend from one end thereof along the longitudinal centerline of that female element and aligned bores 152 extending transversely of the female element longitudinal centerline and intersecting the bore 150 at a location to be aligned with the bore 148 through the projection 146 when that projection is received in the bore 150 in friction fitting engagement therewith. The bore 150 is sized to snugly receive the projection 146 in such friction fitting engagement.

A cotter pin 160 is attached to the female element by a chain 162 and is sized to fit through the aligned bores 148 and 152 to attach the male and female elements of the connecting assembly together.

For the sake of reference, elements 62, 94, 99 and 108 form the male elements of each connecting assembly, and the elements 48, 74, 92 and 139 form the female elements of each connecting assembly.

The bike can be assembled and disassembled easily by operation of the connecting assemblies, and thus can be stored in a convenient location until needed.

It is understood that while certain forms of the present invention have been illustrated and described herein, it is not to be limited to the specific forms or arrangements of parts described and shown.

I claim:

1. A collapsible water bike consisting entirely of:

A) a pontoon assembly which includes (1) two identical pontoons, each having a top surface and a bottom surface, sides and a longitudinal centerline which extends between a fore and and an aft end, with the bottom surface being curved, (2) a forward mounting bracket and a rear mounting bracket mounted on said top surface near said fore end and said aft end respectively, each mounting bracket being located on said pontoon longitudinal centerline and including (a) a mounting base fixed to said pontoon top surface, (b) an upstanding tubular body having a first end fixed to said mounting base and a female end spaced above said mounting base, (c) said forward mounting bracket tubular body being angled toward one of said pontoon sides and said rear mounting bracket tubular body being angled toward said pontoon fore end, and (d) a non-skid pad mounted on said pontoon top surface between said forward and rear mounting brackets;

B) a front frame assembly which includes (1) a head tube, (2) two identical support tubes, each having one end attached to said head tube and being angled to diverge away from each other away from said head tube and each having a male end connected to the female end of one of said forward mounting brackets, (3) a cross bar receiving element mounted at one end on said head tube and extending toward said pontoon aft ends and having a female end spaced from said head tube, (4) a downtube mounting bracket mounted at one end thereof on said head tube and having a male end spaced from said head tube toward the aft end of said pontoons, and (5) a cross bar having a first male end connected to the female end of said cross bar receiving element and a second male end spaced from said cross bar receiving element toward said pontoon aft ends;

C) a steering assembly mounted on said head tube and including (1) a rod attached at one end to said head tube and a rudder attached at the other end of said rod, and (2) a handle bar assembly mounted on said head tube and including (a) a handle bar mounting rod mounted on said head tube and connected to said steering assembly rod, and (b) a handle bar unit mounted on said handle bar mounting rod to rotate said steering assembly rod when said handle bar unit is rotated;

D) a seat assembly which inc)includes (1) a seat post having a cross bar receiving element attached at one end thereof to said seat post and having a female end attached to said cross bar second male end, (2) a seat mounted on said seat post, (3) a unitary seat tube connected at one end thereof to said seat post and having a male end spaced from said seat post, (4) a triangular seat supporting frame which includes (a) three identical legs which are connected together to form an equilateral triangle with a top apex connected to said seat post, said triangular seat supporting frame being in a plane that extends downwardly from said seat post and rearwardly towards said pontoon aft ends, (b) an extension tube on each of the other two apexes of said triangle, with each extension tube extending outwardly of said triangle and which having a male end thereon attached to the female end of one of said rear mounting brackets, and (c) a bracket arm attached at one end thereof to one of said triangle legs and extending toward said pontoon fore end and having a female end spaced from said triangle leg, said bracket arm having a first bearing element attached thereto;

E) a propulsion assembly which includes (1) a support element attached at a male end thereof to the female end of said bracket arm, (2) a mounting bracket attached at one end to said support element and having a female end connected to the male end of said seat tube, (3) a second bearing element dependently connected to said support element, (4) a driver gear rotatably attached to said down tube mounting bracket and to said propulsion assembly mounting bracket, and having two identical L-shaped crank arms attached thereto and foot pedals attached to each of said L-shaped crank arms to rotate said driver gear, said driver gear having gear teeth thereon.

(5) a driven gear meshed with said driver gear teeth to be rotated by said driver gear, and (6) a drive shaft connected at one end to said driven gear and being supported by said first and second bearings and having a propeller attached at a second end thereof to rotate as said driven gear rotates; and F) a connecting assembly connecting each male end to an associated female end, each connecting assembly including (1) an annular shoulder on the male end, (2) a projection on the male end extending out of said annular shoulder, (3) a longitudinal bore defined in the female end, said longitudinal bore being sized to snugly receive said male end projection, (4) a male end transverse bore in the male end and extending through said projection, (5) a female end transverse bore intersecting said female end longitudinal bore on diametrically opposite sides thereof, said male end transverse bore being located and sized to be aligned with said female end transverse bore when said projection is received in said female end longitudinal bore, and (6) a chain connecting cotter pin to said female end.

* * * * *